United States Patent [19]

Monaco

[11] 4,142,717

[45] Mar. 6, 1979

[54] BATTING PRACTICE MAT

[76] Inventor: Ernest Monaco, 325 Hillside Ave., Nutley, N.J. 07110

[21] Appl. No.: 862,565

[22] Filed: Dec. 20, 1977

[51] Int. Cl.[2] ..... A63B 69/40

[52] U.S. Cl. ..... 273/26 R; 124/41 R; 273/102 S

[58] Field of Search ..... 273/26 R, 26 A, 181 R, 273/181 A, 95 R, 95 G, 102 B, 102.4, 105 R, 105 A, 102 S, 29 A, 96 R, 127 R, 127 B

[56] References Cited

U.S. PATENT DOCUMENTS

| | | | |
|---|---|---|---|
| 1,879,316 | 9/1932 | Kleb | 273/26 A |
| 2,059,365 | 11/1936 | King | 273/26 A |
| 2,254,986 | 9/1941 | Ziel | 273/26 A |
| 2,873,969 | 2/1959 | Ziel | 273/26 A |
| 2,978,246 | 4/1961 | Groningen | 273/26 A |
| 2,988,360 | 6/1961 | Lambiotte | 273/26 A |
| 2,992,002 | 7/1961 | Bingham, Jr. | 273/26 A |
| 3,172,661 | 3/1965 | Scheemaeker | 273/26 A |
| 3,428,318 | 2/1969 | Vick | 273/26 A |
| 3,810,616 | 5/1974 | Murphy | 273/26 A |
| 3,994,498 | 11/1976 | Breslow | 273/95 G |

FOREIGN PATENT DOCUMENTS

| | | | |
|---|---|---|---|
| 17099 of | 1907 | United Kingdom | 273/105 A |

*Primary Examiner*—Richard C. Pinkham
*Assistant Examiner*—T. Brown
*Attorney, Agent, or Firm*—Norman N. Popper; Daniel H. Bobis

[57] ABSTRACT

A batting practice mat comprising a sheet of dense resilient, thick material having substantially its entire surface perforated by holes slightly smaller than a ball whereby a ball may be inserted in a hole and frictionally retained therein; this sheet is suspended from a bracket and held at the top and at the bottom by a plurality of elastic cables. The bracket is adjustable to sustain the sheet at various levels.

6 Claims, 3 Drawing Figures

BATTING PRACTICE MAT

BACKGROUND OF THE INVENTION

1. Field of the Invention

This invention relates generally to batting practice mats, and specifically to batting practice mats having a plurality of apertures substantially covering their entire surface so that the practice batter may observe what is on the other side of the batting practice mat, either when a ball is thrown at the mat or is seized in an aperture in the mat.

2. Prior Art

Numerous devices have been devised to enhance batting skills but none have been calculated to provide instant positive and/or negative feedback as to the correctness of the swing, especially at its most critical phases, the point just preceding contact and the point of contact itself. This correct swing, according to Williams, is a hard push swing, in which the bat describes a flattened arc and at point of contact is approximately perpendicular to the oncoming ball, with the batter's wrists firm and unbroken. All action thereafter, Williams maintains, is of no significance in terms of effect upon the ball.

A multi-sensory device (auditory, visual, tactile) providing instant, strong, positive feedback in cases of appropriate execution and instant, string, negative feedback in cases of inappropriate execution via a number of sensory modalities (e.g. auditory, visual and tactile) would be highly significant to teacher and learner in that continued practice, would produce significant, superior patterns of performance as the learner immediately adjusts to avoid the punitive or unpleasant consequences of incorrect execution and seeks the pleasant and rewarding experience of proper execution.

SUMMARY OF INVENTION

It has been found that a batting practice mat can be devised which provides instant, strong tactile, visual and auditory feedback of a pleasant, positive nature for the proper execution and instant strong punitive or negative reenforcement in the event of improper execution thereby eliciting, if not compelling the performer to repeat proper performances and/or make adjustments in the event of negative performances.

This is accomplished by suspending a relatively thick, dense, perforate mat immediately before the practice batter so that he may strike at a ball pitched toward him from the opposite side of the mat, or strike at a ball captured in one of the apertures in the mat. When the mat is struck properly (e.g. The flattened arc prescribed by Williams) in the location of the fixed ball, the ball will rebound forcefully providing instant positive visual reenforcement, while, the contact of the bat with the mat and auditory will yield a resounding and easily distinguished positive ausitory response. The firm engagement of the barrel of the bat, (wrists firm and unbroken, driving through as in the William's hard push.) with the mat provides a pleasant tactile sensation. When the mat is struck improperly (e.g. non flattened arc) only the end of the bat will strike the mat, thereby, making strong and positive contact with the ball very unlikely, and providing instant negative visual reenforcement since the ball will remain engaged in the aperture or will be weakly propelled forward. The lack of firm engagement of bat and mat also yields a very weak and unresounding auditory response immediately signifying negative performance. In addition, the impact of the end of the bat upon the mat as in a rounded arc where the end of the bat precedes the wrists, concentrates a disproportionate flow of shock to the hands and wrist which is noticeably unpleasant thereby decreasing the likelihood of similar performances. Thus by focusing the attention of the learner upon the critical phase of the swing — the moment preceding contact, and the point of contact, through the use of strong, multi-sensory, immediate positive and/or negative reenforcement, continued practice will compel a superior pattern of performances, while, simultaneously discouraging inferior patterns of execution.

THE DRAWINGS

These objects and advantages as well as other objects and advantages may be attained by the device shown by way of illustration and drawings in which.

PREFERRED EMBODIMENT

Figure 1:
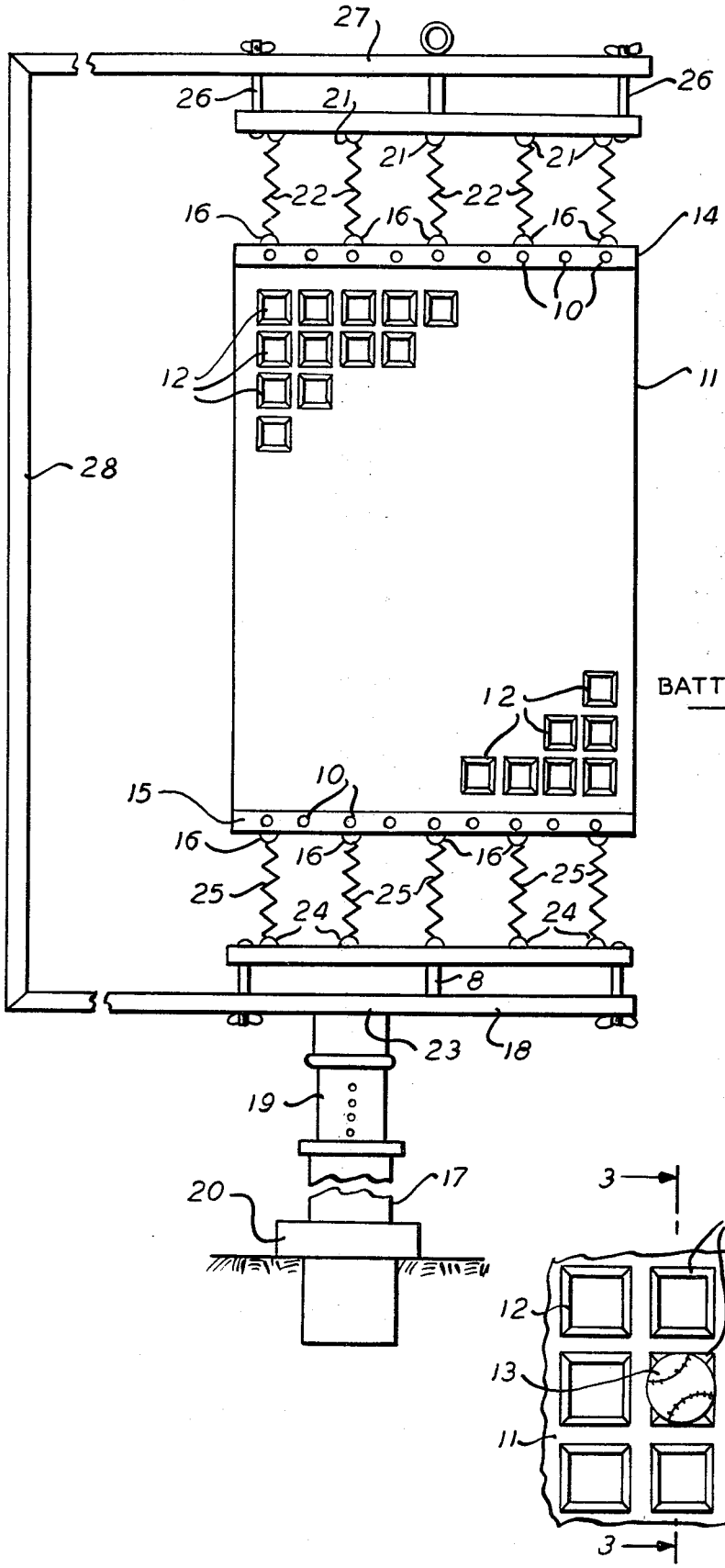
FIG. 1 is an elevational view of the batting practice mat suspended from a support.
Figure 3:
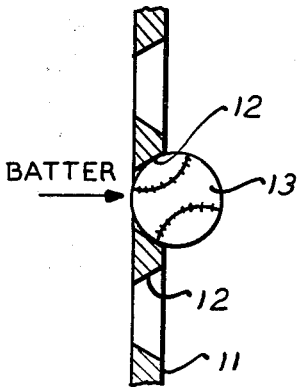
FIG. 3 is a vertical sectional view of the mat, showing the tapered apertures, for holding a ball.
Figure 2:
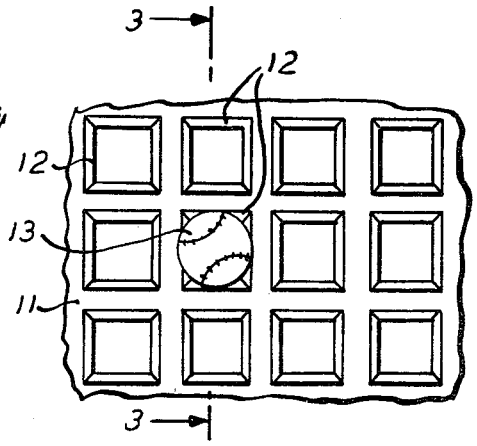
FIG. 2 shows a standard hard ball frictionally engaged with an aperture in the mat.

Referring now to the drawings in detail, the batting practice mat is a generally rectangular sheet 11. It is provided with a plurality of apertures 12. The apertures are shown to be generally rectangular and are dimensioned slightly smaller than a ball 13 with respect to which batting practice is to be conducted. The chosen dimension is such so that a ball 13 may be applied to any one of the apertures 12 and pressed so as to deform the aperture and become frictionally engaged with the chosen aperture 12. The composition of the sheet is preferably of a tough durable plastic, natural rubber, or synthetic rubber. It may also be made of a quilted fabric. The sheet 11 should be sufficiently tough so as to withstand repeated blows with a bat. It should be sufficiently dense so that when it is struck firmly and strongly with a bat used in batting practice, it will give a resounding thud, if the bat strikes the sheet firmly and squarely, but will not give any resounding thud if the sheet is not struck squarely and firmly. As to the precise dimension of the apertures and the spacing from each other, they may be approximately $2\frac{3}{8}''$ wide and $2\frac{3}{4}''$ long on pitching side and $2'' \times 2\frac{1}{4}''$ on batting side. This is slightly smaller than the diameter of a standard hard ball. A different size is selected for the standard soft ball, or any other type of ball. When such a ball 13 is applied to the chosen aperture 12 and pressed firmly into it, the aperture 12 may be deformed and will seize and frictionally engage the ball. The top of the sheet 11 is attached to a top bar 14 and the bottom of the sheet is attached to a bottom bar 15. These bars 14, 15 may be made of rigid metal and are secured to the sheet 11 by rivets 10 or by bolts and nuts passed through the bars 14, 15 and through the sheet 11. A plurality of rigid loops 16 are applied to the top bar 14 and to the bottom bar 15 as a means for attaching the sheet 11 to an appropriate support. The sheet 11 which constitutes the batting practice mat is to be suspended at a height generally opposite a bat held by the practice batter. To accomplish the suspension of the sheet 11, a generally vertical tube 17 is provided. This tube 17 is fitted into a ground socket 20. A telescoping section 19 slides within the tube 17 to provide height adjustment. The section 19 is attached to a horizontal extension 18. One end of the horizontal extension 18 is connected to a vertical bar 28. At the top of the vertical bar 28, there is another horizontal extension 27. These horizontal extensions 18, 27 provide the means to support the sheet 11.

On the horizontal extension 18, there is a bottom pivot 8, and on the horizontal bar 27, there is a top pivot 6. An upper bar 9 is pivotably attached to the top pivot 6 and a lower bar 7 is pivotably attached to the bottom pivot 8. To prevent the upper bar 9 and the lower bar 7 from rotating on the pivots 6, 8, bolts 26 secured by wing nuts are passed through the horizontal extension 27 and the lower bar 9, and through the horizontal extension 18 and the corresponding lower bar 7. Releasing the bolts 26, permits the mat 11 to be reversed for a left handed batter. The lower bars 7, 9 have a plurality of rigid loops 24. The top bar 14 and the bottom bar 15 also have a corresponding plurality of loops 16. The loops 16 on the bottom bar 15 are connected to the loops 24 on the lower bar 7 by springs 22 or elastic cables. The loops 16 on the top bar 14 are also connected to the loops 24 on the lower bar 9 by springs 25 or elastic cables. When the telescoping tubes 17, 19 are adjusted so as to place the batting practice sheet 11 generally opposite the practice batter, the practice batter stands in front of the sheet approximately within a bat's length from the sheet. From the opposite side of the sheet, a batting practice ball is pitched at the sheet and the practice batter swings at the sheet with the intention of striking the ball as it impacts with the sheet. The position and progress of the ball 13 is readily observed by the batter through the apertures 12. In order to provide for the practice batter's ability to make observations through the sheet 11, the apertures are placed close together with tapered solid portion between them no greater than approximately ¼" on pitcher's side to approximately ¾" on batter's side, thereby enabling a virtually unobstructed view of the position and progress of the ball as it is pitched toward the sheet from the opposite side from the practice batter. If the bat is swung properly (e.g. William's Flattened Arc Push Swing) it will meet the sheet generally at the point of impact of the ball, and project the ball away from the sheet. If the bat is swung improperly, the ball may be missed all together or it may weakly dribble away from the sheet 11 while transmitting unpleasant shock to the wrists of the performer. In addition to the visual image which the practice batter observes in his practice, an audible response may be heard from the sheet 11 being struck by the bat in a proper fashion. There will be a resounding whack if the bat properly strikes the sheet and the ball in coincidence. On the other hand, an improper swing, or slipping the bat off, rather than driving through, will yield unimpressive auditory feedback.

Since the sheet 11 is rotatable on the pivots 8, 6, it may be swung around to accommodate a right handed or left handed batter. But to maintain the sheet stable, the ends of the upper bar 9 is attached by bolts 26 to the top horizontal extension 27. Likewise the lower bar 7 is attached by bolts 27 to the bottom horizontal extension 24.

Another method of using the batting practice mat is to insert a ball 13 in a chosen aperture 12 at a high level, at a low level, at an intermediate level, close to the right side, or close to the left side of the sheet. When the ball 13 is applied to the sheet and frictionally engaged therewith, the practice batter swings at the ball in an effort to hit it squarely and drive it from the sheet. A properly hit ball 13 will involve the bat striking the sheet 11 and yielding a resounding whack. A poorly hit ball 13 will only cause the ball to dribble from the orifice 12 where it was captured and there will be no resounding whack.

The use of the batting practice mat is designed to intensify visual, auditory and tactile sensation of the practice batter, seeing the ball driven away from the sheet 11, hearing the resounding whack of the bat on the sheet 11, and feeling impact transmission through the bat as communicated to the hands of the batter. The quality of each of these modality responses is different between a successful batting action and an improper batting action so that a kinesthetic response is generated in the practice batter. The proximity of the sheet 11 to the practice batter concentrates the senses of the practice batter on the conduct or discipline that he is engaging in. A variety of stimuli result from each practice swing and the dominating stimuli will be those which will impress themselves more strongly on the practice batter. Thus with repeated practice, learning patterns are developed coordinated with the "good," visual, auditory, and tactical stimuli, so that improved techniques are persistently developed in correspondence with the stimuli produced by the batting practice mat. Good responses become identified with pleasurable or satisfactory stimuli originating from the practice mat, and in this manner learning patterns are positively reinforced (Motor Learning and Human Performance by Robert N. Singer, page 87), (Bryant J. Cratty, Movement Behavior and Motor Learning, page 47), "Feedback and Skill Learning" by Margaret Robb, Research Quarterly, March 1968, pages 175–184, Williams, Ted; "The Science of Hitting."

What is claimed is:

1. A batting practice mat comprising, (a) A support means, (b) a generally rectangular sheet having attachment means vertically suspending said sheet in a generally vertical plane to said support means, (c) a plurality of tapered apertures in said sheet, the maximum size of said apertures being slightly smaller than the diameter of a ball having a conventional size, (d) said sheet being deformable at least around said apertures to frictionally engage a ball, (e) a ball being frictionally engagable with an aperture in said sheet such that a batter positioned on the side of said sheet where the tapered holes are smallest can strike a ball to practice batting strokes.

2. A batting practice mat comprising, (a) the device according to claim 1, wherein said attachment means includes (b) a rigid bar attached to the top of the sheet, and said support (c) a rigid bar attached to the bottom of the sheet, and said support (d) and said sheet being means to suspend between attached said to rigid bars and said support

3. A batting practice mat comprising, (a) the device according to claim 1, (b) the means to suspend the sheet being springs.

4. A batting practice mat comprising, (a) the device according to claim 1, (b) said means to suspend said sheet being elastic members.

5. A batting practice mat comprising, (a) the device according to claim 1, (b) said means to support said sheet including pivotal means whereby the position of said sheet may be reversed, so that a batter either left or right handed may use said practice mat.

6. A batting practice mat comprising, (a) the device according to claim 1, (b) the means to support said sheet further includes a telescoping, adjustable, vertical support.

(c) the means to suspend the sheet including top and bottom horizontal extensions on a vertical support attached respectively to the top and bottom of the sheet.

* * * * *